US005964111A

United States Patent [19]

Lambert

[11] Patent Number: 5,964,111

[45] **Date of Patent: *Oct. 12, 1999**

[54] PICK-RESISTANT PIN-TUMBLER LOCK

[76] Inventor: Carl L. Lambert, 385 Main Rd., Savoy, Mass. 01256

[ * ] Notice: This patent issued on a continued prosecution application filed under 37 CFR 1.53(d), and is subject to the twenty year patent term provisions of 35 U.S.C. 154(a)(2).

[21] Appl. No.: 08/905,415

[22] Filed: Aug. 4, 1997

Related U.S. Application Data

[60] Provisional application No. 60/027,020, Sep. 23, 1996.

[51] Int. Cl.[6] ..... E05B 27/00

[52] U.S. Cl. ..... 70/493; 70/380; 70/381

[58] Field of Search ..... 70/380, 383, 379, 70/381, 356, 421, 412, 493, 389, 390, 391, 403, 404

[56] References Cited

U.S. PATENT DOCUMENTS

| | | | |
|---|---|---|---|
| 31,278 | 1/1861 | Yale, Jr. . | |
| 48,476 | 6/1865 | Yale, Jr. . | |
| 414,720 | 11/1889 | O'Keefe . | |
| 899,955 | 9/1908 | Collins | 70/380 |
| 1,384,022 | 7/1921 | Best . | |
| 1,417,132 | 5/1922 | Barker . | |
| 2,427,837 | 9/1947 | Connell | 70/383 |
| 3,648,492 | 3/1972 | Walters et al. | 70/404 |
| 3,961,507 | 6/1976 | Falk . | |
| 4,621,510 | 11/1986 | Scherbing . | |
| 5,000,019 | 3/1991 | Foster | 70/389 |
| 5,148,690 | 9/1992 | Wang | 70/38 A |
| 5,176,015 | 1/1993 | Sussina . | |
| 5,475,997 | 12/1995 | Chung | 70/375 |

*Primary Examiner*—Steven Meyers
*Assistant Examiner*—Teri Pham

[57] ABSTRACT

A pick resistant lock assembly has two lock sections which can be opened in two stages separated by time using a single key. Both lock sections share the same multiple stacks of locking pin tumblers which engage the machined depths provided on the key, but only the first lock section includes a key plug. The second lock section is also provided with the addition of an extra stack of locking pin tumblers completely isolated from any contact with the key or any picking tools, which pin stack is operated solely from a cam that is machined into the first locked section and serves to supplementally lock only the second locked section until after the first locked section is rotated slightly by the use of the key, whereupon the second locked member is released from being locked by the isolated stack of locking pin tumblers and is then also made connective to the first lock section by a single pin of the isolated locking pin stack becoming connective to the end wall of the cam cavity such that the first lock section and second lock section can then be rotated together, but only if the selectively machined key had been used in the beginning, else further rotation of either member is prevented by the multiple stacks of locking pin tublers that are common to both.

4 Claims, 5 Drawing Sheets

PICK-RESISTANT PIN-TUMBLER LOCK

This application claims the benefit of U.S. Provisional Application No. 60/027,020 filed Sept. 23, 1996.

BACKGROUND OF THE INVENTION

This invention relates to pin-tumbler locks that are pick-resistant, and more particularly to pin-tumbler locks of both the concentric cylinder type and the tandem disk type that include defensive means to resist picking.

Pin-tumbler locks of the concentric cylinder type of the prior art are described and shown in the early patents of Linus Yale (U.S. Pat. No. 31,278 and U.S. Pat. No. 48,476). A typical pin-tumbler, key-operated, cylinder lock is opened by a key that raises each pin stack within the lock until the bottom of the top pin of each stack lines up with the common circumferential surfaces of an inner cylinder and an outer housing bore. When all pin stacks are thus aligned, the key can rotate the inner cylinder and thereby operate any number of mechanisms attached to the far end of that cylinder or cammed by it.

Pin-tumbler locks of the tandem disk type of the prior art are described and shown in the patents of Frank Scherbing (U.S. Pat. No. 4,621,510) and Morris Falk (U.S. Pat. No. 3,961,507). A typical tandem disk pin-tumbler lock (often known as a tubular key lock) is one wherein a disk plate rotates one end flat surface against a stationary flat surface internal to the housing of the lock, and bores aligned through both plates contain pin stacks and springs. Like the concentric cylinder type, the moving plate can rotate only if the lock's key pushes on all pin stacks in a proper combination to line up the bottoms of all top pins with the interface plane between the movable plate and the housing's immovable mating surface. A concentric shaft extending as a part of the movable plate through the back of the housing is often used as a means to drive cams or mechanisms to unlock the device wherein the lock is assembled.

Any currently manufactured pin tumbler key-operated lock can be picked or manipulated open or otherwise compromised by (1) the application of a rotating or probing force upon its locking cylinder or locking disk while simultaneously (2) pushing, positioning, or separating the locking pin stack elements with appropriate tools.

Various pin-tumbler locks exist that use a second rotating member, whether a concentric cylinder or a tandem disk, but none has been created that cannot be picked, manipulated, or impressioned to an unlocked state without the use of its provided key.

Prior art structure, wherein a pin-tumbler lock utilizes a second cylinder concentric to a first for the purpose of making the lock pick-resistant but without using a second stage of unlocking is shown by Barker in U.S. Pat. No. 1,417,132.

Prior art structure of an improved pin-tumbler lock that uses a second tandem disk for the purpose of simple resetting of the lock for several different key codes is set forth by Falk in U.S. Pat. No. 3,961,507.

Prior art structure of a pin-tumbler lock that uses a second cylinder concentric to a first for the purpose of greater security in master-keying is set forth by O'Keefe in U.S. Pat. No. 414,720.

Prior art structure of a pin-tumbler lock that uses a second cylinder concentric to a first for the purpose of convenient removal of the lock's core from its housing by using a second key is set forth by Best in U.S. Pat. No. 1,384,022.

As such it may be appreciated that there continues to be a need to improve the security of pin-tumbler locks from picking, manipulation, and impressioning as set forth by the instant invention which addresses both the problems of effectiveness of security and ease of construction.

SUMMARY OF THE INVENTION

An object of this invention is to provide a pin-tumbler lock in which neither a rotating nor probing force can be applied simultaneously with manipulation of pin stack elements. The instant invention improves pick-resistance of such locks by dedicating a second rotating member to use as a second stage required to unlock it.

In accordance with this invention a pin-tumbler lock has two concentric cylinders or two tandem disks within a housing, both cylinders or disks sharing common locking pin stacks. The first cylinder or disk accepts a key to rotate it, but it does not itself unlock the lock. The second cylinder or disk is the body that must be rotated to effect unlocking, and this second body cannot be rotated until the first is slightly rotated by itself to (1) release another independent locking mechanism upon the second body and to also (2) connect the first body to the second so that the first may then cause the second to rotate. The common pin stacks are fitted with multiple pin segments and springs such that any key can push these stacks any incremental amounts to release the first body, but only one key of possible millions will push the stacks appropriately to release both bodies.

The result of this arrangement of two cylinders or two disks is that the common pin stacks are pushed by any key to release the first or both of those bodies, but only the first body can initially be rotated even if both are released. The operation of pin stack adjustments for both bodies is allowed at this point. At this time no rotating or probing forces can be applied to the second body even though rotating or probing forces can be easily applied to the first body. It must be noted here that picking or manipulation of the first body is not only extremely simple, but highly encouraged, to the ultimate security of the lock. Once the pin stacks are intersected by the slight rotating of the first body, then no further adjustment of them can be made. After farther slight rotating of the first body to actuate the independent mechanism, the second body is freed to rotate by the independent mechanism's actions and subsequently a rotating force for the second body is also provided by that mechanism, which then takes the form of an interconnection between the two bodies. If the proper key was initially used to push the common pin stacks, it will now be found that these stacks are properly adjusted to also allow the second body to rotate, else the second body still will not rotate in spite of its release by the independent mechanism and in spite of the application of a rotating force to it; and it is at this point that it would be necessary to readjust the common pin stacks, but that has been previously rendered impossible. A wrong key would now have to be rotated back to the starting position and removed to try another key.

The pin-tumbler lock of this invention utilizes an insecure locking device within a secure locking device wherein a conventional lock blade key or tubular key raises or pushes stacks of internal pins of this locking device to predetermined levels to allow cylinders or disks to then rotate. However, in this design a primary body (cylinder or disk) shares the same multiple stacks of pins with a secondary body (concentric cylinder or tandem disk). When any key is inserted the pin stacks are raised to satisfy the release of one or both of the bodies, but only the primary body will rotate at first. Rotating this primary body slightly causes another mechanism within the lock to release its secure hold upon the secondary body and then to also connect the first body to the second body so that the first can then cause the second body to rotate.

The pin stacks are loaded with many small pin segments in their lower or near ends such that any key (including all wrong keys) can release the first body to rotate slightly, which releases the securing of the secondary body by the independent mechanism which in turn then connects the primary body to the secondary body. But longer and fewer pin segments in the upper or far ends of the pin stacks will have been raised to levels that allow the rotating of the secondary body only if the proper key was used to set those levels initially. No wrong keys will accomplish this secondary body's release even though any of them will release the primary body because of the many, many pin segments provided to allow this for the primary body. Since the secondary body will not rotate until the first body has already rotated slightly, then there is no manipulation or picking technique possible that depends upon rotating pressure being applied to this secondary body prior to the pin stacks being raised. And since the primary body has to be rotated slightly before the third mechanism independently releases its hold upon the secondary body, thus the pin stacks are interrupted and prevented from being further raised, lowered, or otherwise adjusted, and manipulation is thereby further prevented upon said stacks at the crucial position where manipulation is needed for successful picking. It is the rotating of the secondary body that ultimately actuates a cam, lever, or other device to release or throw the bolt or release the shackle of any lock of current common manufacture. Complete isolation of the secondary body of this lock design from all external influences and devices further helps prevent manipulation or picking of the lock without the proper key.

DETAILED DESCRIPTION OF THIS INVENTION

Figure 1:
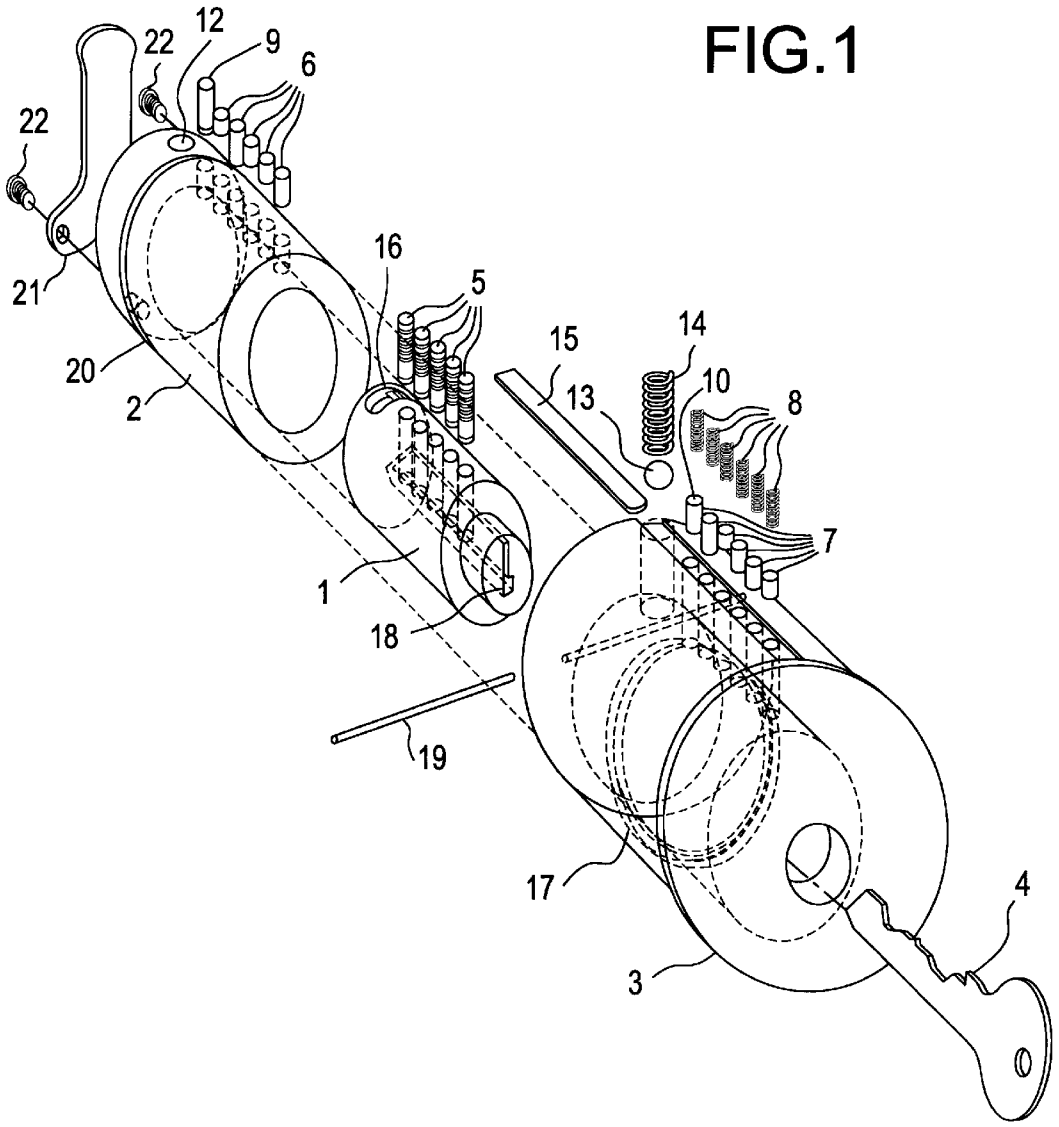
FIG. 1 is an exploded view of the concentric cylinders type of pin-tumbler lock of this invention.

Particulars Of This Invention (Lock Type Using Concentric Cylinders)

It is the intent of this invention to provide for an intermediary cylinder between the cylinder of the lock, which is in direct contact with the key, and the outer housing of the lock, not so as to provide an alternate shear line for master keying or as an alternate shear line for key-operated core removal from the lock housing, as has been designed into other locks, but rather as a shield to separate the rotating function of the first cylinder from the "picking" or pin stack manipulation process. In other words, upon inserting a key into the keyway 18 of the inner cylinder 1 (FIG. 1), the pin stacks are or are not raised to the proper levels at that time, depending upon whether the correct cut depths are present upon that key. The inner cylinder 1 must then be rotated (either clockwise or counterclockwise, depending upon the needs of the mechanisms that the lock is operating) by an amount that allows a cam pin stack 9 and 10 to drop down on one side or the other of the pin cam 16 groove, at which time the shear line between parts 9 and 10 will allow cylinder 2 to rotate within the housing 3. And the bottom cam pin 9 will then also become connective between the inner cylinder 1 and the intermediate cylinder 2 which then allows the key 4 to also rotate 2 as it further rotates 1. Even if the wrong key has been inserted, the inner cylinder 1 will rotate to this point because of a multitude of pins (known in the trade as master pins) in each pin stack area that comprises what is known as the bottom of the pin stacks 5. But since it is the shear line between the intermediate pins 6 and the top pins 7 that really determines whether the intermediate cylinder 2 can be rotated, if the wrong key has been inserted it will not be discovered until after cylinder 1 has been rotated beyond the point where any pins in any of the stacks can be further manipulated. If the correct key is being used, then further rotating of 1 pushes upon the side of the bottom cam pin 9, which itself conveys that force to rotate the intermediate cylinder 2, and, since all the shear lines between the pins 6 and 7 are now properly aligned, cylinder 2 will indeed further rotate. As shown in the drawing, the cam 21 can now operate whatever other mechanisms that are designed to latch or unlatch an associated device, such as a door lockset. The cam groove is machined into the surface of the inner cylinder such that it is extends radial and perpendicular to the axis of the inner cylinder. The bottom surface of the cam groove forms a cam surface. Unlike the pin stacks, the cam groove does not intersect the keyway.

The design of the invention herein actually prevents picking or jiggling of the lock by both removing access to the pin stacks at a time when such access is most needed by the person or device doing the manipulating, and also by removing access altogether to the intermediate cylinder 2 that is actually the cylinder that must be rotated to effect an unlocking (or relocking). A multitude of pins is provided at the bottom level of each pin stack 5 purposefully so that any key will rotate cylinder 1 and any slight "picking" activity will easily cause rotating of the inner cylinder 1. But only the right key (or by pure luck, the right "picking") will cause the shear lines between pins 6 and pins 7 to be properly aligned. And only after the inner cylinder 1 is rotated sufficiently will any rotating of the intermediate cylinder 2 be started. By that time all of the intermediate pins 6 and top pins 7 are shielded by the walls of the inner cylinder 1 from any further access. If the number of captured bottom pins 5 by the intermediate cylinder 2 is not proper at that time, then the shear line between pins 6 and 7 will be too high or too low to allow rotating of the intermediate cylinder 2 within the housing 3.

Furthermore, the cam pin stack (9 & 10) is operated independently of any key or any picking, simply because no access is ever provided to it through the keyhole or anywhere else.

Several other methods of picking pin-tumbler locks are also defeated by the invention herein. Should one manage to gain access to any lever or cam 21 attached to the intermediate cylinder 2 and try to use it to apply a rotational force while manipulating the pin stacks 5 with another tool inserted through the keyway 18, the following principles of design should defeat those efforts. Firstly, the holes bored into the housing 3 to accommodate the pins 6 and 7 and the springs 8 are purposefully machined slightly larger than the matching holes in parts 1 and 2 to accommodate the rest of those corresponding pin stacks. Secondly, the holes bored in parts 2 and 3 to accommodate the cam stack pins 9 and 10 are more precisely machined to match the diameters of pins 9 and 10. Thereby, pressure to "feel" or "hold" or "jam" pins 6 and 7 by rotating intermediate cylinder 2 within housing 3 is precluded because the bottom cam pin 9 prevents sufficient rotation (as helped by these deliberate differences) without first rotating the inner cylinder 1, and that of course prevents further raising or manipulation of the pins 5, 6 and 7.

The process of "shimming" a lock is one where a thin, longitudinally curved shim is inserted between the wall of a cylinder and the wall of its containing bore in order to manipulate pins by raising them with another tool inserted into the keyway while forcing the shim against the stack of pins. When the shim encounters the shear line between two pins of a stack of pins, it will easily slip between them and hold them there while the shim is then advanced to do the same thing to the next stack in line. Since it is necessary to hold the two cylinders 1 and 2 of this lock within the housing 3, especially during such time that a proper key is operating the lock, pin 19 is positioned through the walls of the outer housing 3 to rest in the pin groove 20 of the intermediate cylinder 2. Its position thereby also precludes the act of "shimming" the pins 6 and 7. The inner cylinder 1 is captured within the cavity formed by inserting the intermediate cylinder 2 within the housing 3 and therefore needs no further securing. Since the keyway cavity 18 within the inner cylinder 1 does not protrude through the opposite end of 1, the design of this invention thereby gives no further access to the pin stacks or to the intermediate cylinder 2 itself via shimming techniques of any simple kind, nor can other rotating points for the intermediate cylinder 2 be found without obvious drilling or other detectable damages to the lock.

And, of course, should pick guns or vibrators be used to try to defeat the security of this invention, one must remember that such devices have a very narrow "window" of timing to effect rotating of the cylinder that actually unlocks the lock. Certainly, pick guns or vibrators could effectively separate the top pins of this invention from the rest of their respective pin stacks, but it is the intermediate cylinder 2 that must be rotated to accomplish an unlocking, not just the inner cylinder 1. And the intermediate cylinder 2 cannot rotate until the cam pin stack 9 and 10 drops and follows down the cam 16 of the inner cylinder 1. If the spring 11 of the cam pin stack can cause the cam pin stack to function properly within this "window" of time, then certainly all the rest of the springs 8 for all the rest of the pin stacks (5, 6, & 7) can restore those pins to their locked positions long before rotating of the intermediate cylinder is even started.

Furthermore, impressioning of such a lock would also be impossible. Certainly, a prepared blank could be inserted into the lock, and the bottom pin or pins of each stack could be successively held to produce impressioning marks, but because there are many master pins, the impressioning would proceed to any shear point between any two pins of each stack. It will not be known to the impressioner which shear point is the correct one to stop at, even if he did not stop at the first one met. After all, the rotating action on the key during impressioning is working upon the bottom pins 5 and at the wrong shear line of the cylinders 1 and 2 since the intermediate cylinder 2 cannot be rotated at this point anyway.

The theory of all the above has been tested and works remarkably well. However, during the rotating of one cylinder within another, and the further rotating of that second cylinder within a third housing, the control of any predictable position of the intermediate cylinder 2 is impossible whenever the correct key for the lock is used, especially when it is the purpose of this invention to not give any control of this intermediate cylinder 2 to an abuser of the lock. Therefore a device may be unlocked (or locked), but with the intermediate cylinder 2 acting as though it had a mind of its own, it is impossible to realign it by any amount of rotating of the key such that all pin stacks can once again return to their original position, or even be raised to allow removal of the key. Hence the introduction of the spring 14 and ball 13 to cause a stopping point by the ball 13 resting under spring pressure within the ball dimple 12 thusly to allow a perfect alignment or realignment of the intermediate cylinder 2 within the housing 3 to allow the pin stacks 6 and 7 to be raised and lowered properly again. The pressure of spring 14 is great enough, in fact, so as to require significant extra momentary rotating force on the key to raise the ball out of the dimple in order to cause the intermediate cylinder 2 to rotate within the housing 3. Rotating the inner cylinder 1 by applying rotating pressure to the key 4 therefore results not only in operating the cam pin stack 9 and 10, but when the cam stack finally frees the intermediate cylinder 2 to rotate within the housing 3 and provides the connection between the inner cylinder 1 and the intermediate cylinder 2 to do this rotating, a "click" or stopping point is felt from the holding force of the spring 14 forcing the ball 13 into the dimple 12. By rotating (clockwise or counterclockwise) the key 4 and causing the inner cylinder 1 to similarly rotate, then one may force the ball out of the dimple 12 by rotating the intermediate cylinder 2. Rotating the intermediate cylinder 2 far enough will then cause unlocking (or locking) of the device to which it is attached. Further rotating brings the key 4 back to its starting position, but one must rotate key 4 a little beyond until the above "click" is felt, at which point the key 4 is then rotated back to its beginning and can then be removed. To the uninitiated user, there seems to be a left of center "clicking" point, and a right of center "clicking" point, which occurs at the angles of rotating the inner cylinder through the range of the cam 16, and is not caused by the seeming presence of two balls and springs operating within two dimples.

One other problem to make this invention work flawlessly had to be overcome. Should a user rotate the inner cylinder 1 in one direction and then decide to reverse direction (perhaps dictated by the device the lock is operating), the bottom cam pin 9 could begin its ride back up the cam slope 16 and jam between that slope and the surface of the bore of the outer housing 3, causing severe wear to the cam 16 surface, or to the bottom cam pin 9, or to the wall of the housing 3 itself if the action were further forced. Therefore, a groove as wide as the diameter of the bottom cam pin 9 is machined into the inner surface of the main bore of the housing 3 sloping away from the cam pin stack bore on one side and sloping back up to the cam pin stack bore on its other side. This internal groove is cut into the housing 3 bore's wall deep enough so that the bottom cam pin 9 can rise up and over the entire cam 16 without the other end of the bottom cam pin 9 touching the wall of the housing 3 whatsoever, no matter where in the revolution of the intermediate cylinder 2 that the direction of revolution is changed, except at the point where the bottom cam pin 9 can reenter the stack bore through the housing 3 for pins 9 and 10. But this groove is cut not so deep such that some of the tip end of cam pin 9 will always protrude within the cam cavity to remain as the driving connection for the inner cylinder 1 to drive or rotate the intermediate cylinder 2.

Figure 2:
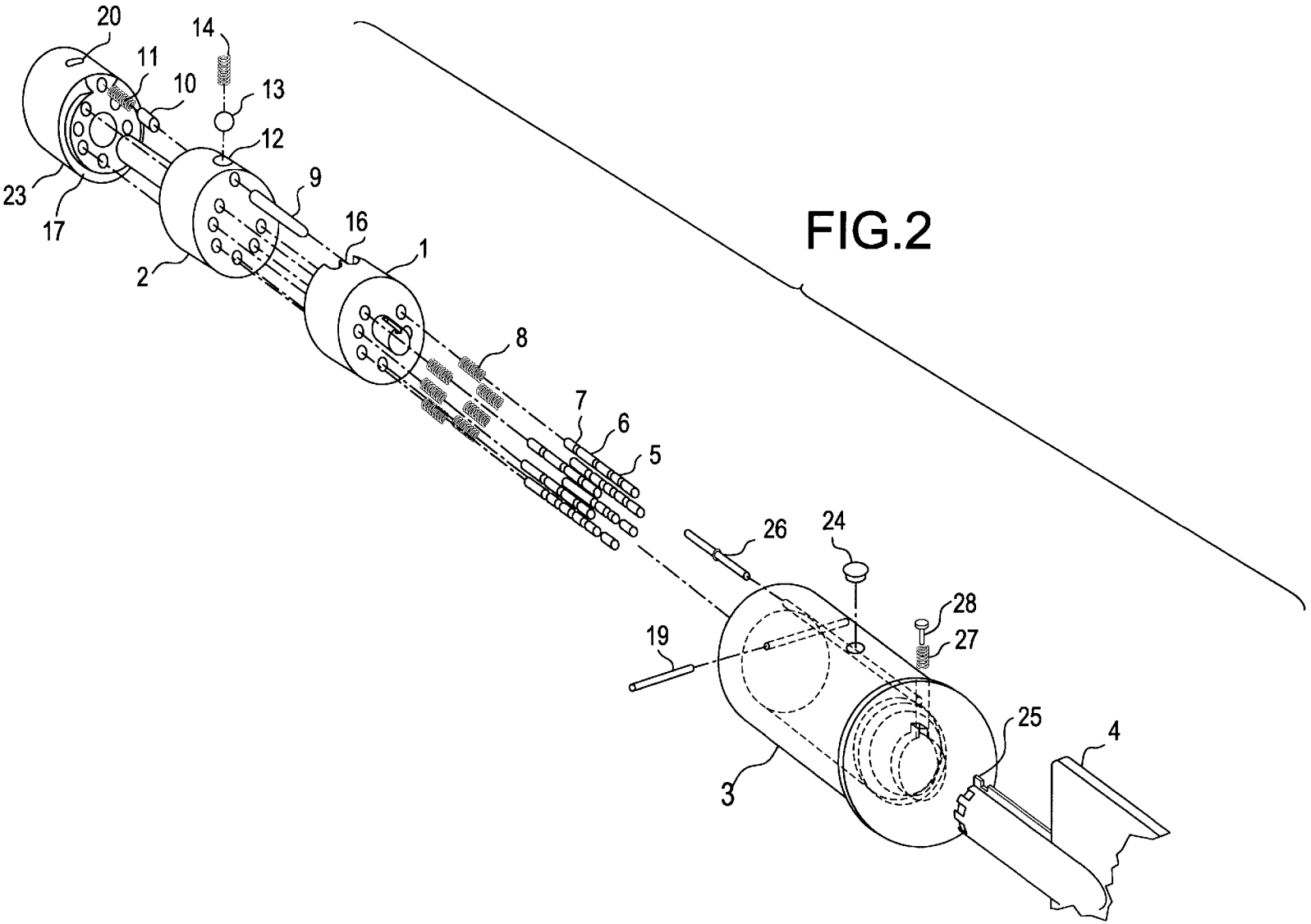
FIG. 2 is an exploded view of the tandem disks type of pin-tumbler lock of this invention.

Particulars Of This Invention (Lock Type Using Tandem Disks):

FIG. 2 shows this invention as it would apply to a rotating plate lock (otherwise known as a tubular key pin tumbler lock); and it is the intent of this invention to apply its principles to this design of lock as well.

Referring to FIG. 2, outer housing 3 of this locking mechanism is once again a standard mortise lock body, and the main bored hole into this body which accommodates parts 1, 2, and 23 can either be centered within the body or it can be offset to accommodate the needs of standard cams used to operate standard door locksets. It is shown centered in FIG. 2. When a key 4 is inserted into the keyhole of this locking mechanism (with its orientation dictated by the nub 25 and the matching nub passage slot of the keyhole itself), it passes within the face hole of the body 3 and captures the central mandrel protruding from the disk 1 within the tubular cavity of the key 4. An internal spline within the key matches an external groove on the mandrel of the outer disk 1, therefore a rotating force applied to the key 4 can be transmitted to the outer disk 1. The leading edge of the tube of the key 4 is machined to allow the bottom pins 5 to be pushed farther into the outer disk 1 more or less, as such machining dictates. Because of a plurality of bottom pins 5 in each pin stack, any combination of standard machining depths in the key 4 can cause the shear points between the bottom pins 5 and intermediate pins 6 to coincide with the interfacial shear plane of the outer disk 1 and the intermediate disk 2 such that the outer disk can then be rotated. Seven such pin stacks and pin bores are shown in the drawing to correspond to the most common manufacture of such disk locks today. More such borings and stacks lend greater security to the lock; fewer would give less security.

Therefore, the outer disk 1 is now rotated allowing the cam 16 to operate the bottom cam pin. Once the bottom cam pin 9 reaches the bottom of the cam, then the shear point between the bottom cam pin 9 and the top cam pin 10 coincides with the shear plane of the intermediate disk 2 and the stationary disk 23 allowing the intermediate disk 2 to rotate. Now then, only if a correctly machined key 4 is used such that the shear points between the intermediate pins 6 and the top pins 7 of all seven pin stacks also line up at the shear plane of the intermediate disk 2 and the stationary disk 23 can the intermediate disk 2 actually be rotated. And the rotating is accomplished by the connection of the outer disk 1 to the intermediate disk 2 by the bottom cam pin 9 now being in contact with one or the other end wall of the cam cavity 16 and also residing within the cam pin bore of the intermediate disk 2, thereby the bottom cam pin 9 is now rotationally connective between the outer disk 1 and the intermediate disk 2. Needless to say, there is only one correct machining of the key 4 that will cause the shear lines between pins 6 and 7 of all the pin stacks to line up to allow rotating of the intermediate disk 2; but there are a vast quantity of key machinings that line up the shear points between pins 5 and 6 to allow the outer disk 1 to rotate. Hence the same features of pick-resistance and impressioning-resistance apply here as given above for the cylinder lock in FIG. 1, even to the further technique of "tilting and rolling" a "loose" key, comparable to the technique of "jiggling" for the concentric cylinder type of lock, and also to the techniques of picking guns and vibrators. "Shimming" this type of lock is not even a consideration because of its inherent design. The cam includes a groove having its longitudinal center lying on a circle concentric to the circumference of the first cylindrical disk such that the groove does not intersect with any of the bore holes of the first cylindrical disk.

Further, as the reverse direction relief groove 17 is critical to the lock in FIG. 1, so also is the relief of the shoulder 17 on the stationary disk 23 important in drawing FIG. 2. And just as the ball 13 and dimple 12 are important to realign the intermediate cylinder 2 of FIG. 1, so too is the ball 13 and dimple 12 of FIG. 2 to realign the intermediate disk of the disk lock. However, one further feature must be noted relative to the key 4 of FIG. 2. In order to further guarantee proper realignment of all the disks of the disk lock, the key 4 must have an orientation nub 25 that prevents the key from being removed from the lock unless the nub is aligned with the matching slot of the outer circumference of the keyhole. This is a standard feature of all current tubular keys currently in use.

Figure 3:
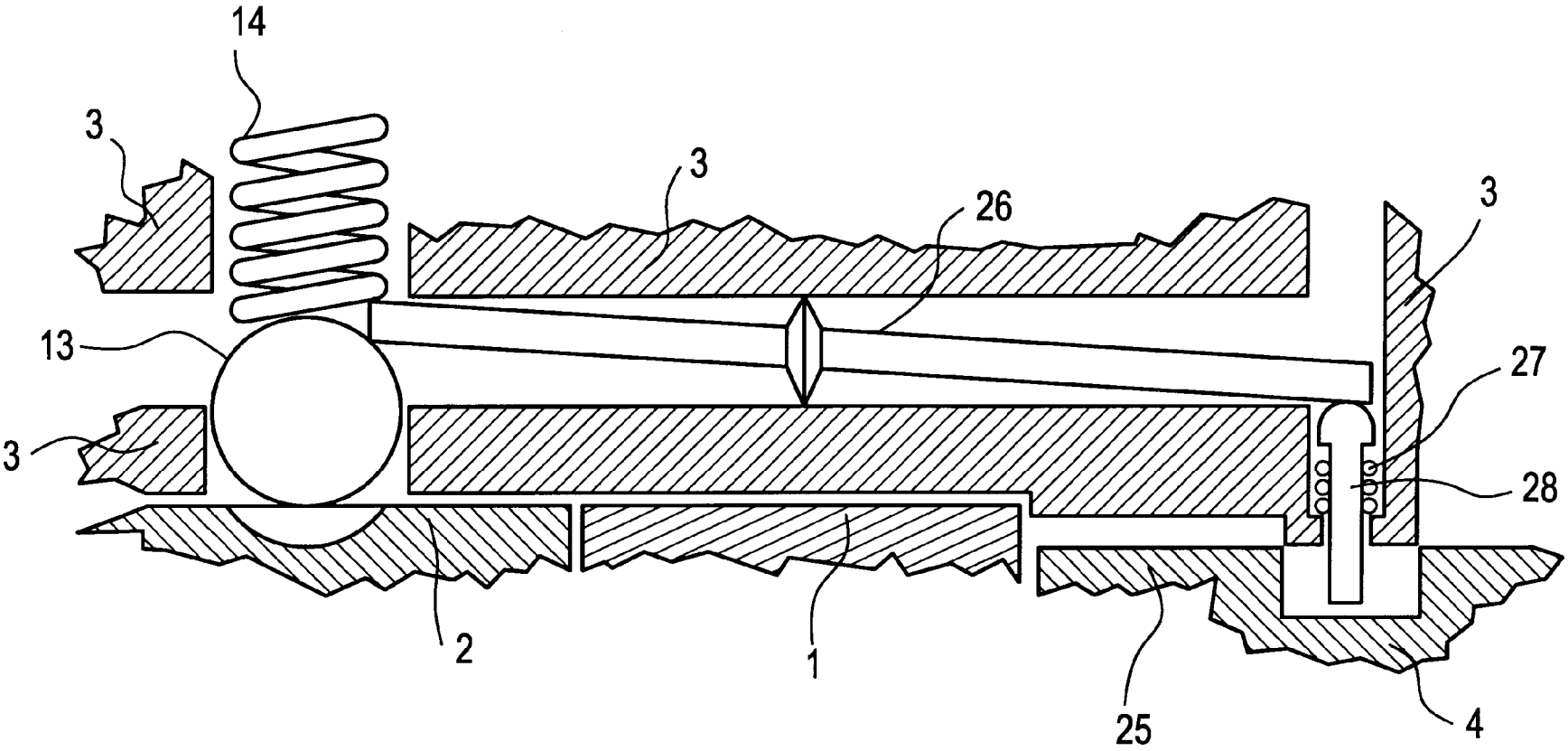
FIG. 3 is a sectional view and enlargement of the mechanism to retain a key in the keyway of the tandem disks type of lock of this invention.
Figure 4:
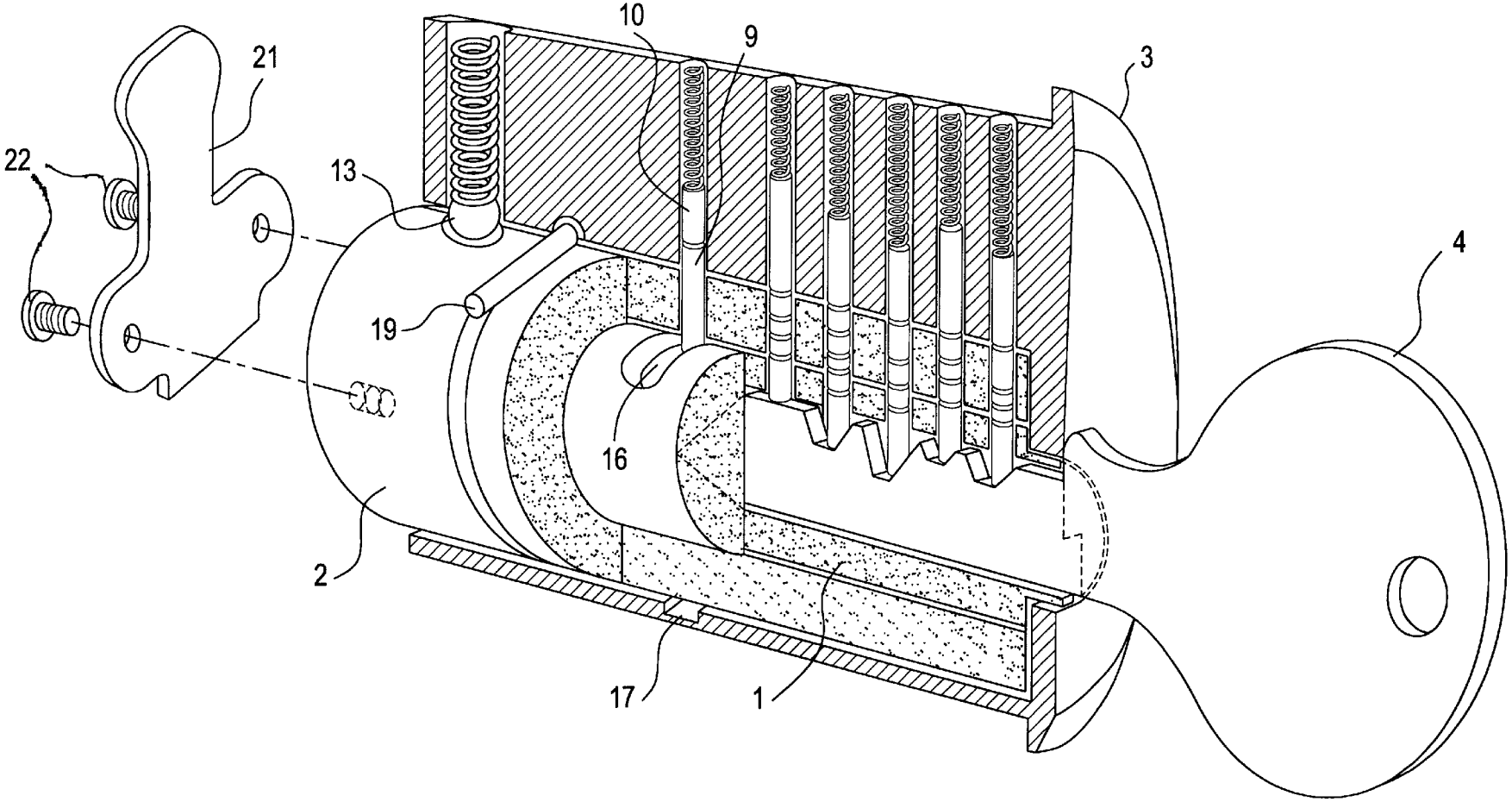
FIG. 4 is a partial sectional view of the concentric cylinder type of pin-tumbler lock of this invention.
Figure 5:
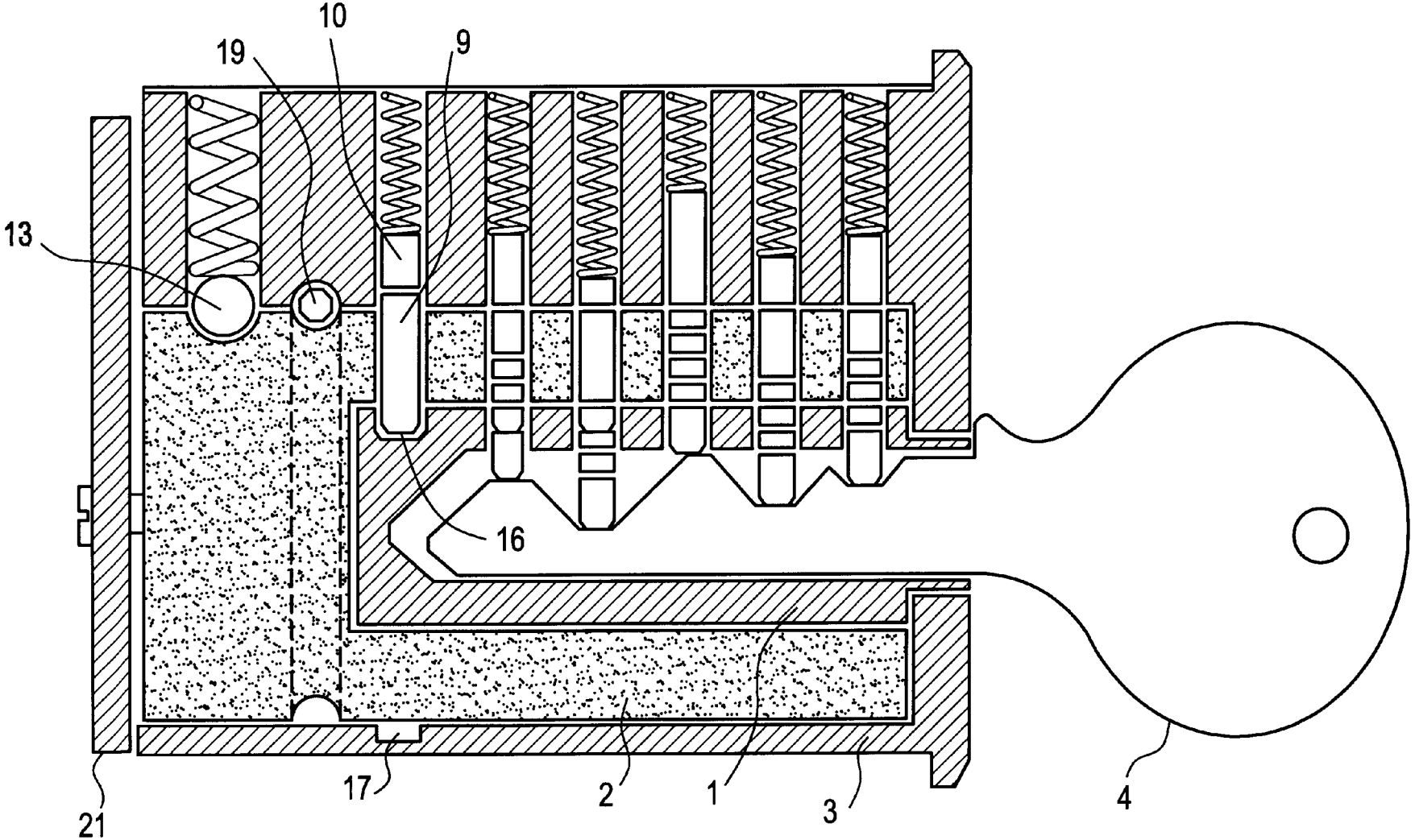
FIG. 5 is a sectional view of the concentric cylinder type of pin-tumbler lock of this invention.

But, further yet, the slot of the outer circumference of the keyhole matching to this orientation nub 25 is not quite enough, in this lock design, to absolutely guarantee that all the pin stacks (5, 6, & 7) are realigned between parts 23, 2 and 1, and so parts 26, 27 and 28 of FIG. 2 and FIG. 3 are provided. Part 28 is pushed downwards by the one end on part 26 whenever the dimple ball 13 raises the other end of 26, therefore the 10 bottom end of pin 28 protrudes into the lock face slot so that nub 25 of key 4 cannot be withdrawn. Only when the dimple ball 13 is reseated down into the dimple 12 will the spring 27 be able to raise pin 28 again, whereupon pin 28 will no longer block the keyway that allows the nub 25 to pass through. Only when the dimple ball 13 is reseated down into the dimple 12 can we be sure that all pin bores and stacks are realigned between parts 23 and 2; and only when the key nub 25 is aligned with its matching slot in the lock face can we be sure that the pin bores and stacks are aligned between parts 2 and 1. The pin 28 prevents removal of the key until the user has followed instructions that enable him to reliably provide for the former.

Note that the bored holes for the pin stacks 5, 6, and 7 of FIG. 2 through the outer disk 1 and similarly through the intermediate disk 2 also extend into, but not necessarily all the way through the stationary disk 23. If they extend all the way through 23 then cap plugs for those bores would be necessary for the springs 8 just as the cap plug 24 is necessary for spring 14. Also the bored holes through 1 and 2 for the cam pins 9 and 10 similarly extend into 23, but do not lie on the same circle pattern as for the bores for pins 5, 6, and 7. In fact it is necessary that the cam pin stack bore lies near the outside circumference of the disks 2 and 23 so that the reverse direction shoulder relief 17 will not effect the shear plane of the regular locking pin stack bores between disk 2 and disk 23.

Further, it should be noted that the central mandrel extending from the intermediate disk 2 protrudes through a clearance bore central in the stationary disk 23 such that cams or other devices necessary to the locking or unlocking of a lockset can be threaded, pinned, or splined to its far end.

What is claimed is:

1. A lock assembly, comprising:

an outer housing having a front end, a rear end, a first bored cylindrical cavity from the rear end to a point near to the front end, and a second smaller bored hole axially coincident with the first bored cavity and extending from the frontal end of the first bored cavity through the front of the outer housing;

an intermediate cylinder having an overall length of the first bored cavity of the outer housing, an overall diameter to slidably and rotatably fit the first bored cavity of the outer housing, a longitudinally and centrally bored cylindrical cavity from its front end to a point near to its rear end having a diameter greater than the diameter of the second bored hole of the outer housing, and a circumferential groove machined completely around its outer cylindrical surface being positioned to avoid intersection with any other subsequent machining of this intermediate cylinder;

an inner cylinder having a diameter to slidably and rotatably fit the bored cavity of the intermediate cylinder, a length matching the length of the bored cavity of the intermediate cylinder, a front cylindrical extension axially coincident to the inner cylinder itself and of a diameter to slidably and rotatably fit the second bored hole of the outer housing, a centered and longitudinal key hole cavity extending from its front end towards its rear end but not extending all the way through its rear end which key hole cavity has an oddly configured cross-section of overall rectangular shape with a narrow width and a height less than the diameter of its front cylindrical extension and its top being along one narrow side;

a lever arm attached to the rear end of the intermediate cylinder;

a plurality of regular cylindrical locking pin bores extending radially from the center of the key-hole of the inner cylinder through the top of the key hole and continuing through the intermediate cylinder and through the outer housing and each having a diameter larger than the width of the key-hole of the inner cylinder, and the diameter of the portion of each of these bores that passes through the intermediate cylinder is additionally made slightly different from the diameter of the portion of each of these bores that passes through the outer housing;

a maximum number of cylindrical pins of minimum practical lengths that slidably fit each of the regular locking pin bores and that do not extend outside the inner cylinder;

a minimum number of cylindrical locking pins of random lengths that slidably fit each of the plurality of locking pin bores and that do not extend outside the intermediate cylinder, but one of these pins for each locking pin bore straddles the boundary between the outer surface of the inner cylinder and the surface of the bore in the intermediate cylinder, this being the means of locking the inner cylinder from rotating within the intermediate cylinder;

a single cylindrical locking pin for each of the plurality of locking pin bores of necessary length to allow space above it within its locking pin bore which pin slidably fits its locking pin bore and straddles the boundary between the outer surface of the intermediate cylinder and the surface of the first bore in the lock housing, this being the primary means of locking the intermediate cylinder from rotating within the lock housing;

a compression spring for each of the plurality of locking pin bores of a diameter to slidably fit each of the locking pin bores holding the stacks of locking pins in their locking positions;

a short cam groove circumferentially machined into the surface of the inner cylinder having end walls that are radial and perpendicular to the long axis of the inner cylinder, the bottom surface of this groove forming a cam surface that has its center nearest to the long axis of the inner cylinder and its two ends at a farther distance equal for both from the long axis of the inner cylinder, and this whole short cam groove having no intersection with the key hole cavity of the inner cylinder;

an additional locking pin bore being on the radial line from the central longitudinal axis of the inner cylinder that passes through the center of the short cam groove of the inner cylinder extending from the surface of the bore in the intermediate cylinder to the outer surface of the lock housing;

a bottom cylindrical pin to slidably fit the additional locking pin bore being of a length that extends from the cam surface of either end of the short cam groove to the boundary between the outer surface of the intermediate cylinder and the surface of the first bore in the lock housing whenever the inner cylinder is rotated to position either end of the short cam in alignment with the additional locking pin bore;

a top cylindrical locking pin slidably fitting on top of the bottom pin within the additional locking pin bore having a length short enough to leave space above it in the additional locking pin bore and being the secondary means that locks the intermediate cylinder to the lock housing when the inner cylinder is rotated to a position bringing the center of the short cam in alignment with the additional locking pin bore;

a compression spring for the additional locking pin bore of a diameter to slidably fit the additional locking pin bore holding the stack of two pins in their locking position;

a bore hole through the lock housing coinciding with the inner curved surface of the first boring of the lock housing but not coinciding with any other boring of the lock housing, coinciding with the groove of the intermediate cylinder, a tightly fitting pin or screw inserted within this bore hole and having a part of this pin or screw occupying part of the space of the groove of the intermediate cylinder, this being the means to retain the intermediate cylinder within the lock housing yet allowing the intermediate cylinder to rotate within the lock housing;

a dimple of a shape less than demi-spherical machined into the outer curved surface of the intermediate cylinder in a position not coinciding with any other boring or grooving of the intermediate cylinder;

a last radial bore hole through the lock housing centered on a radial line directed perpendicularly from the central longitudinal axial line of the first bore hole of the lock housing which line passes through the center of the dimple of the intermediate cylinder, extending from the surface of the first bore hole of the lock housing through the outer surface of the lock housing;

a spherical ball slidably fitting inwardly into the last radial bore hole of the lock housing;

a compression spring slidably and outwardly filling the last radial bore hole of the lock housing to hold the spherical ball within the dimple of the intermediate cylinder;

a removable plate or cap or a plurality of removable plates or caps of common design to plug the outer ends of the plurality of regular locking pin bores and the outer end of the additional locking pin bore and outer end of the last radial bore hole holding the ball and spring;

a flat-bladed key having a body of a cross-section that matches and is slidably fitting into the key hole cavity of the inner cylinder and having a body length to match the length of the key hole cavity of the inner cylinder, provided with a plurality of ramped notches on its top edge of the same number and spacing to match and meet with the bottom ends of the plurality of the bottom most cylindrical locking pins within the regular locking pin bores, said ramped notches being machined to depths that cause all of the stacks of the cylindrical locking pins to be raised to such a level that the junction between a pair of the pins that normally resides within the confines of the inner cylinder for each of the plurality of regular locking pin bores coincides with the boundary between the outer surface of the inner cylinder and the surface of the bore in the intermediate cylinder, and also that the junction between a pair of the pins that normally resides within the confines of the intermediate cylinder for each of the plurality of regular locking pin bores coincides with the boundary between the outer surface of the intermediate cylinder and the surface of the first bore in the lock housing;

whereby, when said key is inserted into the assembly and rotational torque is applied to it, rotation of the inner cylinder is possible and, at the same time, all of the regular cylindrical pin stacks are put in an unlocking position for the intermediate cylinder relative to the outer housing, whereupon rotation of the inner cylinder will cause rotation of the cam groove along with it thereby unlocking the secondary locking of the intermediate cylinder to the lock housing by the additional locking pin stack and further rotation gives connectivity of the end wall of the cam groove to the bottom pin of the additional locking pin stack and will thereby rotate the intermediate cylinder which has connectivity to the rearward lever or shaft that operates the bolt, dog, or stops of the locking device associated with this invention;

and whereby, if any other key fitting to the assembly and not having correctly machined ramped notches is inserted into the assembly and turning torque is applied to it, rotation of the inner cylinder is still possible because of the maximum number of cylindrical pins operational at that level, but rotation may occur only to the point where the end of the cam shaft becomes connective to the bottom pin of the additional locking pin stack because the regular pin stacks will not all be found to be in an unlocked state at that limit of rotation.

2. The lock assembly as claimed in claim 1, wherein differences relating to the additional locking pin bore and cam groove comprise:

said short cam groove circumferentially machined into the surface of the inner cylinder having end walls that are radial and perpendicular to the long axis of the inner cylinder, the bottom surface of this groove forming a cam surface having its center farthest from the long axis of the inner cylinder and its two ends at a nearer distance equal for both to the long axis of the inner cylinder, and this whole short cam groove having no intersection with the key hole cavity of the inner cylinder;

said bottom cylindrical pin to slidably fit the additional locking pin bore being of a length that extends from the cam surface of either end of the short cam groove to the boundary between the outer surface of the intermediate cylinder and the surface of the first bore in the lock housing whenever the inner cylinder is rotated to position either end of the short cam in alignment with the additional locking pin bore, and being the secondary means that locks the intermediate cylinder to the lock housing when the inner cylinder is rotated to a position bringing the center of the short cam in alignment with the additional locking pin bore;

a top cylindrical locking pin slidably fitting on top of the bottom pin within the additional locking pin bore having a length short enough to leave space above it in the additional locking pin bore;

a circumferential groove having a cross-section matching the longitudinal cross-sectional shape of the top of the bottom pin of the additional locking pin bore, having a depth to match that part of the length of that bottom pin that protrudes whenever the inner cylinder is rotated and is then reversed in rotation, being machined outwardly into the lock housing around the circumference of the first bore hole of the lock housing starting on one side of the additional locking pin bore and ending on the opposite side of the additional locking pin bore, the bottom of this groove being ramped back to the original surface level beside the first bore hole of the lock housing on either side of the additional locking pin bore.

3. A lock assembly comprising:

an outer housing having a front end, a rear end, a first bored cylindrical cavity from the rear end to a point near to the front end, a second smaller bored cavity axially coincident with the first bored cavity extending from the frontal end of the first bored cavity to a point closer to the front end, and a third bored hole axially coincident with the first bored cavity and of a diameter smaller than the second bored cavity by more than the diameter of a locking pin used for this lock assembly and extending from the front of the second bored cavity through the front of the outer housing;

a through slot in the wail of the third bored hole of the outer housing extending from the surface of the third bored hole to the line of the surface of the second bored cavity;

a first cylindrical disk having a diameter slidably and rotatably fitting into the front end of the first bored cylindrical cavity of the outer housing, having a length typically less than half of the length of the first bored cavity of the outer housing, and having a front cylindrical extension axially coincident to the first cylindrical disk having a diameter less than the diameter of the third bored hole of the lock housing and a length such that its front end is flush with the front end of the lock housing;

a longitudinal groove machined into the circumferential surface of the front cylindrical extension of the first cylindrical disk;

a second cylindrical disk having a diameter slidably and rotatably fitting next into the first bored cylindrical cavity of the outer housing, having a length typically the same as the first cylindrical disk, and having a rear cylindrical shaft extension axially coincident to the second cylindrical disk having a diameter less than the diameter of the third bored hole of the lock housing and a length longer than a third cylindrical disk following and a geometry or machining of its rearward end to enable joining with a lever or cam to actuate the bolt, dog, or stops of an existing locking device within which or to which this invention is incorporated;

a third cylindrical disk having a diameter slidably and rotatably fitting last into the first bored cylindrical cavity of the outer housing, having a length equal to the remaining length of the first bored hole of the outer housing, and having a bored hole from its front through its rear of a diameter to allow the rear cylindrical shaft extension of the second cylindrical disk to slidably and rotatably fit through it;

a bored hole through the lock housing intersecting the third cylindrical disk but not having any intersection with any other boring or grooving of either the lock housing or the third cylindrical disk, a tight fitting pin or screw being inserted through this bored hole holding the third cylindrical disk stationary within the lock housing and retaining the first cylindrical disk and the second cylindrical disk thus within the lock housing;

a plurality of regular cylindrical locking pin bores having their longitudinal centers parallel to the longitudinal center of the first bored cylindrical cavity of the lock housing and having the line of their longitudinal centers passing through the circle represented by the circumference of the third longitudinal bore of the main housing and extending from the forward end of the first cylindrical disk continuing through the second cylindrical disk and continuing through to nearly the rear end of the third cylindrical disk, and having none of the plurality of regular cylindrical locking pin bores on a line coincident with the radial line of the groove in the top of the front cylindrical extension of the first cylindrical disk nor on a line coincident with the radial line of the slot in the wall of the third bored hole of the lock housing;

a single cylindrical pin for each of the plurality of regular cylindrical locking pin bores having a length slightly greater than the length of the second cylindrical bore of the outer housing, slidably fitting each regular cylindrical locking pin bore and having its front end resting up against the front end wall of the second cylindrical bore of the outer housing;

a maximum number of cylindrical pins of minimum practical lengths that slidably fit next into each of the regular pin bores and that do not extend rearward out of the first cylindrical disk;

a minimum number of cylindrical locking pins of random lengths that slidably fit each of the plurality of locking pin bores and that do not extend rearwardly outside of the second cylindrical disk, but one of these pins for each locking pin bore straddles the facial boundary between the first cylindrical disk and the second cylindrical disk, this being the means of locking the first cylindrical disk from rotating within the lock housing;

a single cylindrical locking pin for each of the plurality of locking pin bores of necessary length to allow space rearwardly within its locking pin bore which pin slidably fits its locking pin bore and straddles the boundary between the second cylindrical disk and the third cylindrical disk, this being the primary means of locking the second cylindrical disk from rotating within the lock housing;

a compression spring for each of the plurality of locking pin bores of a diameter to slidably fit within the rear end of each of the locking pin bores holding the stacks of locking pins in their locking positions;

a short cam groove having its longitudinal center lying on a circle concentric to the circumference of the first cylindrical disk and being forwardly machined into the rearward face of the first cylindrical disk with end walls that are perpendicular to the rear face of the first cylindrical disk, having its forward base machined as a cam surface with the center of the cam nearest to the front of the first cylindrical disk and its two ends at a farther distance equal for both ends from the front of the first cylindrical disk, and this whole short cam groove having no intersection with any of the bore holes of the first cylindrical disk;

an additional locking pin bore paralleling the longitudinal center axis of the first bore of the outer housing and centering on a circle equal in diameter to the circle defining the center of the short cam groove and being in line with the center of the short cam groove when all of the regular pin bores are respectively aligned between the first cylindrical disk and the second cylindrical disk, and the third cylindrical disk, extending from the front surface of the second cylindrical disk through to nearly the rear surface of the third cylindrical disk;

a forward cylindrical pin slidably fitting the additional locking pin bore being of a length that extends from the cam surface of either end of the short cam groove to the boundary between the rear surface of the second cylindrical disk and the forward surface of the third cylindrical disk whenever the first cylindrical disk is rotated to position either end of the short cam in alignment with the additional locking pin bore;

a cylindrical locking pin slidably fitting the additional locking pin bore, being placed rearwardly of the forward cylindrical pin of the additional locking pin bore, being of a length that leaves space in the rear end of the additional locking pin bore, and being the secondary means that locks the second cylindrical disk to the third cylindrical disk whenever the first cylindrical disk is rotated to position the center of the short cam in alignment with the additional locking pin bore;

a compression spring for the additional locking pin bore of a diameter to slidably fit the additional locking pin bore holding the stack of two pins in their locking position;

a dimple of a shape less than demi-spherical machined into the outer curved surface of the second cylindrical disk in a position to have no intersection with any other boring of the second cylindrical disk;

a first radial bore hole through the lock housing centering on a radial line directed perpendicularly from the central longitudinal axial line of the second cylindrical disk which radial line passes through the center of the dimple of the second cylindrical disk, extending from the surface of the first bore hole of the outer housing through the outer surface of the outer housing;

a spherical ball slidably fitting inwardly into the first radial bore hole of the outer housing;

a compression spring slidably and outwardly filling the first radial bore hole of the outer housing to hold the spherical ball within the dimple of the second cylindrical disk;

a cap to plug the outer end of the first radial bore hole holding the ball and spring;

a key having a body of cylindrical shape, having an outside diameter slidably fitting within the third bore hole of the outer housing, having a bore from its rearward end towards its front end of a length greater than the length of the front cylindrical extension of the first cylindrical disk and of a diameter slidably fitting to the front cylindrical extension of the first cylindrical disk, having this bore being concentric with the outer circumference of the body of the key, having an internal longitudinal spline slidably fitting to the external groove of the front cylindrical extension of the first cylindrical disk, having an external nub that extends from the rearward end of the key body a distance forward slidably and rotatably equal to the length of the second bore hole of the outer body of the lock assembly and that has a cross-section and placement to slidably fit through the slot in the surface of the third bore hole of the outer body of the lock assembly;

a plurality of axially oriented grooves around the circumference of the rear end of the key each groove matching and in alignment with a regular cylindrical locking pin bore, the cavity of the grooves slidably fitting along a side of the ends of the forward most regular cylindrical pins of the regular cylindrical locking pin bores, and the lengths of these grooves being such that the forward end of each groove pushes those pins rearward an amount to cause the boundary between two pins in each regular cylindrical locking pin bore to coincide with the interfacial boundary of the rear of the first cylindrical disk and the front of the second cylindrical disk and also so that the forward end of the most rearward pin of each pin stack is in alignment with the inter facial boundary of the rear of the second cylindrical disk and the front of the third cylindrical disk;

a hole for a center-pivoted lever bored from the rear of the outer housing extending almost to the front face of the outer housing, its longitudinal center perpendicularly intersecting the longitudinal center of the first radial bore of the outer housing at a distance more than half the diameter of the spherical ball from the surface of the first cylindrical bore of the outer housing, and its longitudinal center ending on a radial line from the longitudinal axis of the third cylindrical bore of the outer housing that passes through the center of the through slot in the wall of the third bored hole of the outer housing;

a first cylindrical hole for a key-retaining pin bored from the outer surface of the outer housing, its center axis perpendicularly intersecting the center axis of the hole for a center-pivoted lever and extending almost to the outer surface of the through slot in the wall of the third bored hole of the outer housing;

a second hole for a key-retaining pin, beginning at the inner end of the first hole for a key-retaining pin, having a diameter smaller than the first hole for a key-retaining pin, having its center axis coincident with the center axis of the first hole for a key-retaining pin, extending through the outer surface of the through slot in the wall of the third bored hole of the outer housing;

a compression coil spring for a key-retaining pin slidably fitting the first cylindrical hole for a key-retaining pin, having an inside diameter slightly greater than the diameter of the second hole for a key-retaining pin;

a round-headed pin being the key-retaining pin, having the diameter of its head slidably fitting to the first cylindrical hole for a key-retaining pin, having the diameter of its body slidably fitting within the second hole for a key-retaining pin, having its head concentric with its body, being of a total length to extend from the center of the hole for a center-pivoted lever to the outer face of the slot in the wall of the third bored hole of the outer housing and held in that position by the compression coil spring for a key-retaining pin;

a rod being the center-pivoted lever, having a central diameter slidably fitting within the hole for a center-pivoted lever, having a very short length for this central diameter and tapering to a diameter for the rest of the body of the rod that extends to both ends of the rod that is equal to less than half the diameter of the hole for a center-pivoted lever, and having a length to extend from a point in contact with and outwardly past the center of the spherical ball to a point outwardly in contact with the center of the head of the key-retaining pin and continuing to nearly contact the forward wall of the first cylindrical hole for a key-retaining pin;

whereby, when said key is inserted into the assembly and rotational torque is applied to it, rotation of the first cylindrical disk is possible and, at the same time, all of the regular cylindrical pin stacks are put in an unlocking position for the second cylindrical disk relative to the third cylindrical disk, whereupon rotation of the first cylindrical disk will cause rotation of the cam groove along with it thereby unlocking the secondary locking of the second cylindrical disk relative to the third cylindrical disk by the additional locking pin stack and further rotation gives connectivity of the end wall of the cam groove to the forward pin of the additional locking pin stack and will thereby rotate the second cylindrical disk which has connectivity to the rearward cylindrical shaft extension that operates the bolt, dog, or stops of the locking device associated with this invention;

and whereby, if any other key fittable to the assembly and not having correct lengths for all of its plurality of grooves is inserted into the assembly and turning torque is applied to it, rotation of the first cylindrical disk is still possible because of the maximum number of cylindrical pins operational at that level, but rotation may occur only to the point where the end of the cam shaft becomes connective to the forward pin of the additional locking pin stack because the regular pin stacks will not be found to be in an unlocked state at that limit of rotation;

and further, if any attempt is made to remove a key from this assembly wherein the regular cylindrical pin bores are not all properly realigned then it will be found that the spherical ball is also not seated properly within the dimple of the second cylindrical disk and therefore the rearward end of the center-pivoted lever will be pushed in a direction away from the center of the first cylindrical bore of the outer housing causing the forward end of the center-pivoted bar to be levered in a direction toward the center of the third cylindrical bore of the outer housing which in turn causes the key-retaining pin to be depressed and thusly preventing the key from being removed from the lock.

4. The lock assembly as claimed in claim 3, wherein differences relating to the additional locking pin bore and cam groove comprise:

said short cam groove having its longitudinal center lying on a circle concentric to the circumference of the first cylindrical disk and being forwardly machined into the rearward face of the first cylindrical disk with end walls that are perpendicular to the rear face of the first cylindrical disk, having its forward base machined as a cam surface with the center of the cam farthest from the front of the first cylindrical disk and its two ends at a nearer distance equal for both ends to the front of the first cylindrical disk, and this whole short cam having no intersection with any of the bore holes of the first cylindrical disk;

said forward cylindrical locking pin slidably fitting the additional locking pin bore being of a length that extends from the center of the cam surface of the short cam groove to the boundary between the rear surface of the second cylindrical disk and the forward surface of the third cylindrical disk whenever the first cylindrical disk is rotated to position either end of the short cam in alignment with the additional locking pin bore, and being the secondary means that locks the second cylindrical disk to the third cylindrical disk whenever the first cylindrical disk is rotated to position the center of the short cam in alignment with the additional locking pin bore;

a top cylindrical pin slidably fitting rearward of the forward cylindrical pin within the additional locking pin bore having a length short enough to leave space rearward of it in the additional locking pin bore;

a circular groove having a cross-section matching the longitudinal cross-sectional shape of the rear of the forward cylindrical locking pin of the additional locking pin bore, having a depth to match that part of the length of that forward locking pin that protrudes whenever the first cylindrical disk is rotated and is then reversed in rotation, having its center lie on a circle concentric with the outside circumference of the third cylindrical disk whereby the circumference of this circle intersects the longitudinal center of the additional locking pin bore, being machined rearwardly into the forward face of the third cylindrical disk starting on one side of the additional locking pin bore and continuing around the circle to the other side of the additional locking pin bore, and being ramped up to the original facial surface of the third cylindrical disk on either side of the additional locking pin bore.

* * * * *